US006471547B1

(12) United States Patent
Venaleck et al.

(10) Patent No.: US 6,471,547 B1
(45) Date of Patent: Oct. 29, 2002

(54) ELECTRICAL CONNECTOR FOR HIGH DENSITY SIGNAL INTERCONNECTIONS AND METHOD OF MAKING THE SAME

(76) Inventors: John T. Venaleck, 1382 W. Jackson St., Painesville, OH (US) 44077; Larry M. Crofoot, 4536 Baldwin Rd., Perry, OH (US) 44081

( * ) Notice: Subject to any disclaimer, the term of this patent is extended or adjusted under 35 U.S.C. 154(b) by 0 days.

(21) Appl. No.: 09/585,064

(22) Filed: Jun. 1, 2000

Related U.S. Application Data

(60) Provisional application No. 60/136,994, filed on Jun. 1, 1999.

(51) Int. Cl.[7] ..... H01R 13/648
(52) U.S. Cl. ..... 439/608; 439/701
(58) Field of Search ..... 439/607, 608, 439/701, 492, 499

(56) References Cited

U.S. PATENT DOCUMENTS

| | | | | |
|---|---|---|---|---|
| 4,655,518 | A | | 4/1987 | Johnson et al. |
| 4,655,578 | A | | 4/1987 | Kurtz et al. |
| 4,659,155 | A | | 4/1987 | Walkup et al. |
| 4,755,145 | A | | 7/1988 | Johnson et al. |
| 4,846,727 | A | | 7/1989 | Glover et al. |
| 4,869,677 | A | | 9/1989 | Johnson et al. |
| 4,984,992 | A | * | 1/1991 | Beamenderfer ..... 439/108 |
| 5,046,960 | A | | 9/1991 | Fedder |
| 5,055,069 | A | | 10/1991 | Townsend et al. |
| 5,066,236 | A | | 11/1991 | Broeksteeg |
| 5,104,329 | A | | 4/1992 | Brown et al. |
| 5,104,341 | A | | 4/1992 | Gilissen et al. |
| 5,151,036 | A | | 9/1992 | Fusselman et al. |
| 5,174,770 | A | | 12/1992 | Sasaki et al. |
| 5,238,414 | A | | 8/1993 | Yaegashi et al. |
| 5,286,212 | A | | 2/1994 | Broeksteeg |
| 5,342,211 | A | | 8/1994 | Broeksteeg |
| 5,403,206 | A | | 4/1995 | McNamara et al. |
| 5,435,757 | A | | 7/1995 | Fedder et al. |
| 5,443,403 | A | | 8/1995 | Weidler et al. |
| 5,460,533 | A | * | 10/1995 | Broeksteeg et al. ..... 439/101 |
| 5,484,310 | A | | 1/1996 | McNamara et al. |
| 5,496,183 | A | | 3/1996 | Soes et al. |
| 5,525,066 | A | * | 6/1996 | Morlion ..... 439/108 |
| 5,632,634 | A | | 5/1997 | Soes |
| 5,632,635 | A | | 5/1997 | Vanbesein et al. |
| 5,660,551 | A | | 8/1997 | Sakurai |
| 5,664,968 | A | | 9/1997 | Mickievicz |
| 5,702,258 | A | | 12/1997 | Provencher et al. |
| 5,795,191 | A | | 8/1998 | Preputnick et al. |
| 5,860,816 | A | | 1/1999 | Provencher et al. |
| 5,882,214 | A | | 3/1999 | Hillbish et al. |
| 6,102,747 | A | * | 8/2000 | Paagman ..... 439/701 |

* cited by examiner

*Primary Examiner*—Khiem Nguyen
(74) *Attorney, Agent, or Firm*—Renner, Otto, Boisselle & Sklar, LLP

(57) ABSTRACT

A high density electrical cable connector has a primary structural support or spine that is made of an electrically conducting material. The cable connector has a strain relief or cable retainer attached at one end of the spine for securing a cable to the spine. The cable connector has electrically conductive terminals at an opposite end, the terminals having contact portions for receiving and electrically connecting to other terminals, such as pins or other contacts on an electronic or electrical device such as a circuit board and/or another electrical connector. An intermediate layer of non-conducting material between the terminals and the spine electrically isolates the terminals from the spine. Wires from the cable may be attached to the terminals, so as to form an electrically conductive path between the cable and other terminals connected, e.g., pins, received by the terminals. One of the wires from the cable may also be attached to the spine to maintain the spine at a ground or other reference voltage. The spine is in relatively close proximity to the terminals to provide a voltage reference plane, such as a voltage reference plane, and is thus cooperative with the terminals to maintain and/or to control impedance in the circuit paths of the cable connector.

37 Claims, 8 Drawing Sheets

ELECTRICAL CONNECTOR FOR HIGH DENSITY SIGNAL INTERCONNECTIONS AND METHOD OF MAKING THE SAME

This application claims the benefit of U.S. Provisional Application No. 60/136,994, filed Jun. 1, 1999.

FIELD OF THE INVENTION

The invention is in the field of electrical connectors and methods of making the same.

BACKGROUND OF THE PRIOR ART

Electrical connectors have been made by stacking together multiple connector modules. Use of multiple modules reduces manufacturing costs and increases flexibility in enabling construction of electrical connectors of various size. However, stacking multiple connector modules may lead to unacceptable errors in connector tolerances. Errors in the tolerances of individual modules, for example errors in the thickness of the individual modules, may accumulate or be added together as multiple modules are stacked together to form an electrical connector. A negative consequence of such accumulation of error may be an improper fit or the inability to fit in connection with a counterpart connector, electrical device, or the like.

In addition, there is a trend toward higher signal densities, which requires less space between contacts or conductors of adjacent modules, and less space between adjacent contacts of the same modules.

Still further, as signal speeds increase and spacing becomes smaller, the need for signal isolation, shielding, impedance control, and fixed voltage plane reference features also may increase and/or may require more accurate tolerances.

It will be understood from the foregoing that a need exists for improved electrical connectors.

SUMMARY OF THE INVENTION

A high density electrical cable connector has a primary structural support or spine that is made of an electrically conducting material. The cable connector has a strain relief or cable retainer attached at one end of the spine for securing a cable to the spine. The cable connector has electrically conductive terminals at an opposite end, the terminals having contact portions for receiving and electrically connecting to other terminals, such as pins or other contacts on an electronic or electrical device such as a circuit board and/or another electrical connector. An intermediate layer of non-conducting material between the terminals and the spine electrically isolates the terminals from the spine. Wires from the cable may be attached to the terminals, so as to form an electrically conductive path between the cable and other terminals connected, e.g., pins, received by the terminals. One of the wires from the cable may also be attached to the spine to maintain the spine at a ground or other reference voltage. The spine is in relatively close proximity to the terminals to provide a voltage reference plane, such as a voltage reference plane, and is thus cooperative with the terminals to maintain and/or to control impedance in the circuit paths of the cable connector.

According to an aspect of the invention, a high density electrical cable connector has an electrically conductive primary structural member.

According to an aspect of the invention, a high density electrical cable connector uses an electrically conductive voltage reference plane member as the primary structural support of the cable connector; a cable, strain relief, and terminals are supported from the member; and the member cooperates electrically in the cable connector to maintain and/or to control impedance characteristics of the cable connector and/or circuit paths thereof.

According to another aspect of the invention, a high density electrical cable connector has an air gap between a strain relief cable retainer and a connector portion, an electrically conductive structural member providing primary structural support in the air gap region.

According to another aspect of the invention, a method of making a high density electrical cable connector is provided.

According to yet another aspect of the invention, a high density electrical cable connector is formed using a reel-to-reel process.

According to a further aspect of the invention, an electrical connection system includes high density electrical cable connectors and a connector carrier having slots for receiving and holding the cable connectors in close proximity.

According to a still further aspect of the invention, an electrical cable connector for high density signal interconnections includes a metal structural member; a plurality of electrically conductive terminals connectable to respective conductors of a cable; and a electrically non-conductive member attached to both the structural member and the terminals. The structural member provides primary structural support for the terminals.

According to another aspect of the invention, a connector carrier for an electrical cable connector assembly includes exterior walls enclosing an interior volume, and a plurality of interior walls within the interior volume, the interior walls dividing at least a portion of the interior volume into a plurality of rectangular slots. An inner surface of at least one of the exterior walls has grooves therein, the grooves being substantially parallel to the interior walls.

According to yet another aspect of the invention, an electrical cable connector assembly includes a connector carrier which includes exterior walls enclosing an interior volume, and a plurality of interior walls within the interior volume, the interior walls dividing at least a portion of the interior volume into a plurality of rectangular slots; and electrical cable connector modules inserted into the slots, each of the cable connector modules including a metal structural member; a plurality of electrically conductive terminals; and an electrically non-conductive member attached to both the structural member and the terminals; and wherein the structural member provides primary structural support for the terminals.

According to still another aspect of the invention, an electrical cable connector assembly includes a plurality of electrical cable connector modules, each of the cable connector modules including a metal structural member; a plurality of electrically conductive terminals connected to a cable; and an electrically non-conductive member attached to both the structural member and the terminals; and wherein the structural member provides primary structural support for the terminals; and a connector carrier having means for receiving and positioning individual of the modules.

According to a further aspect of the invention, a method for constructing an electrical cable connector includes the steps of securing a plurality of electrically conductive terminals to an electrically non-conductive member; and attaching the non-conductive member and a strain relief to a metal structural member such that an air gap exists between the strain relief and the non-conductive member.

According to a still further aspect of the invention, an electrical cable connector module includes an electrically conductive metal plate, a plurality of electrically conductive terminals secured to the plate by an electrically non-conductive retainer; and an electrical cable secured to the plate by a retainer, the cable having a plurality of conductors electrically coupled to respective terminals.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

Figure 1A:
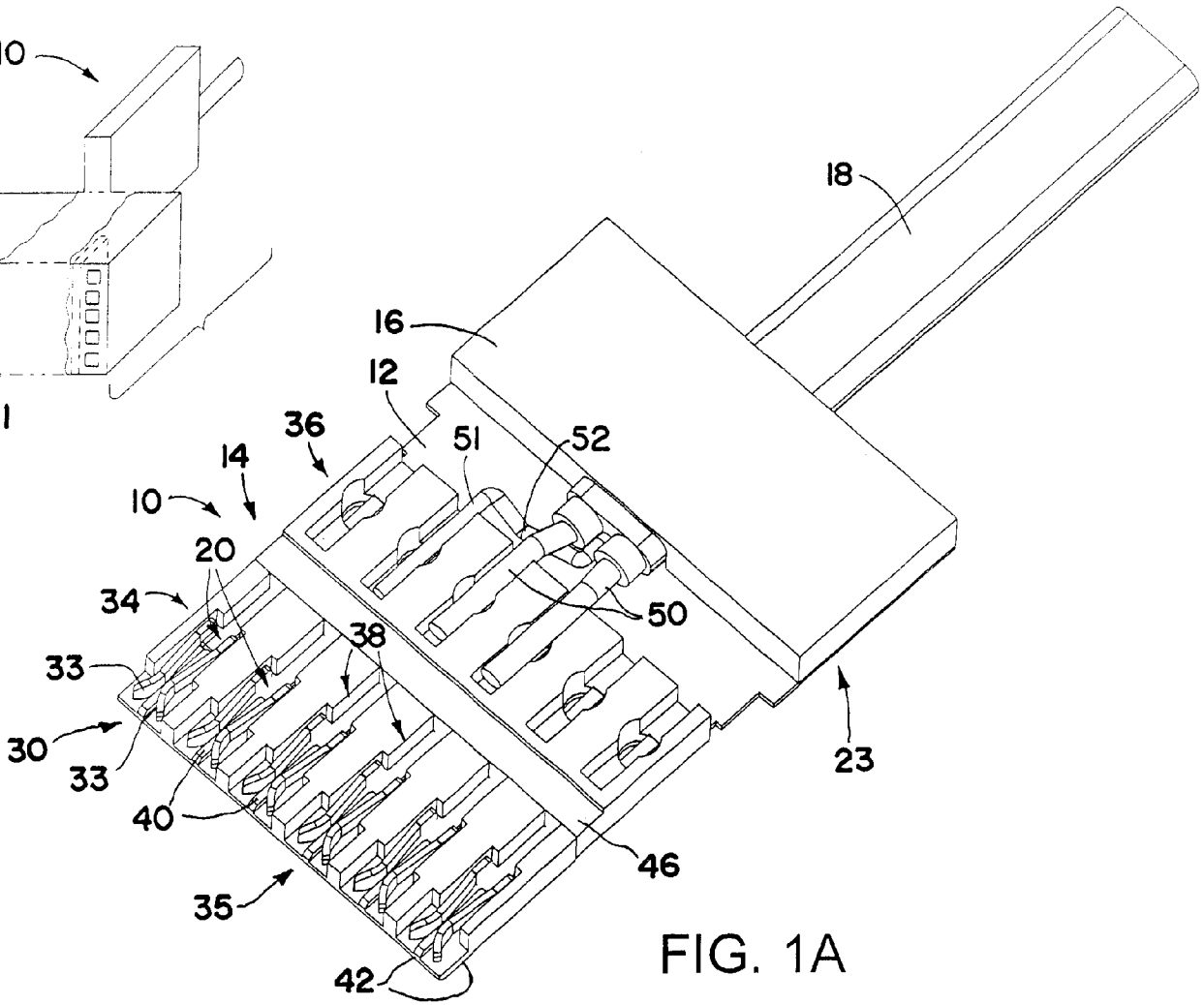
FIG. 1A is a perspective view of a high density electrical cable connector according to the present invention.

Referring to FIGS. 1A, 1B, and 2–19, and initially more specifically to FIGS. 1A, 1B, and 2–6, an electrical connection system 1 includes an electrical cable connector or cable connector module 10 and a connector carrier 11 for high density signal interconnections. The cable connector 10 includes an electrically conductive structural member such as a voltage reference plane or spine 12. The reference plane or spine 12 may be maintained at a ground or other reference voltage. A connection portion 14 and a cable retainer or strain relief 16 are attached to the voltage reference plane 12. The cable retainer 16 secures a cable 18 to the voltage reference plane 12. Wires from the cable 18 are electrically connected to a plurality of terminals 20 which are part of the connection portion 14. The terminals 20 are adapted to receive suitable other terminals (not shown) such as pins emanating from another electrical connector, for example, one mounted on a circuit board.

Figure 1B:
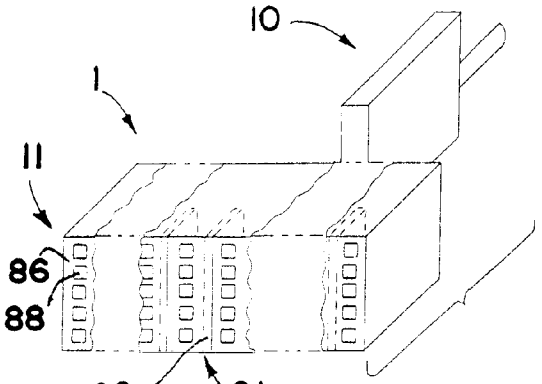
FIG. 1B is a schematic illustration of an electrical connection system having a plurality of electrical cable connectors in accurately spaced-apart relation in a connector carrier.
Figure 2:
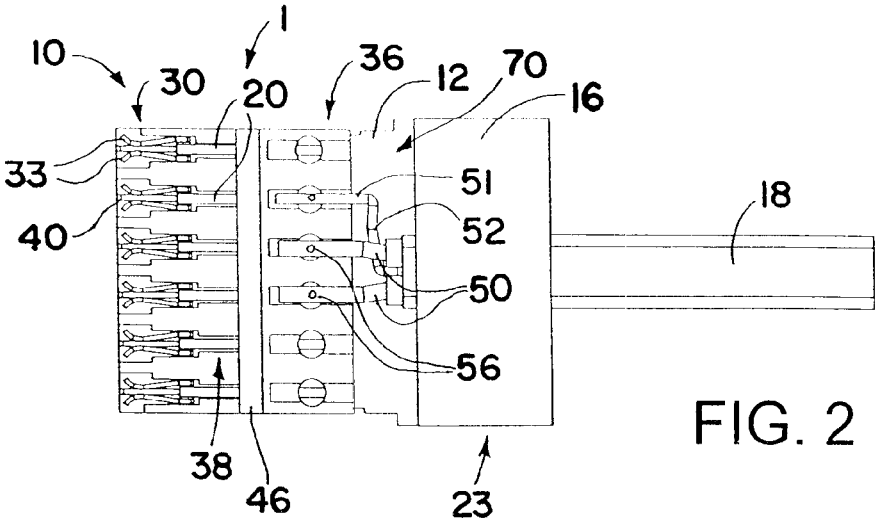
FIG. 2 is a plan view of the electrical cable connector of FIG. 1A.
Figure 3:
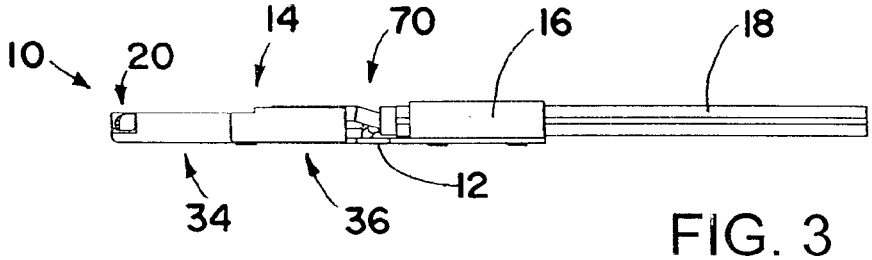
FIG. 3 is a side view of the electrical cable connector of FIG. 1A.
Figure 4:
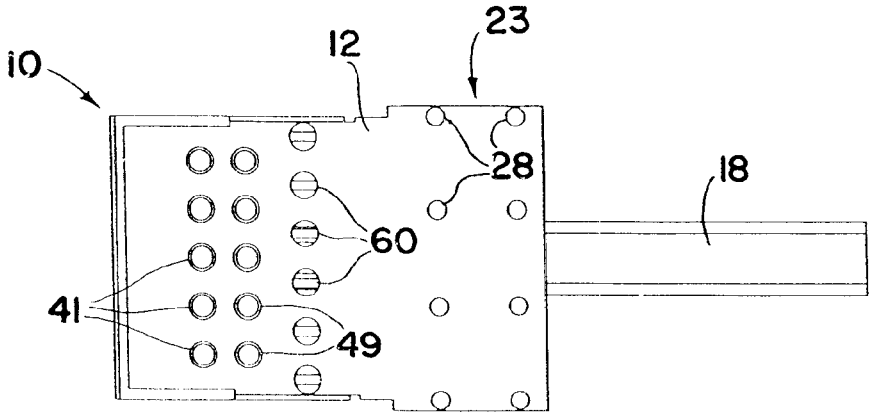
FIG. 4 is a bottom view of the electrical cable connector of FIG. 1A.
Figure 5:
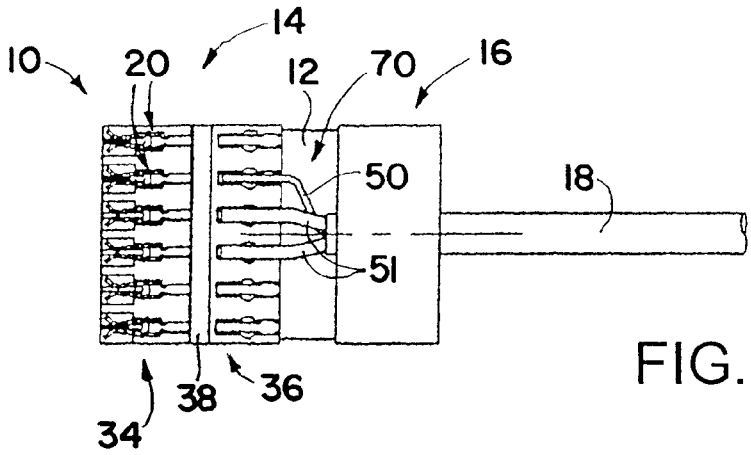
FIG. 5 is another plan view of the electrical cable connector of FIG. 1A.
Figure 6:
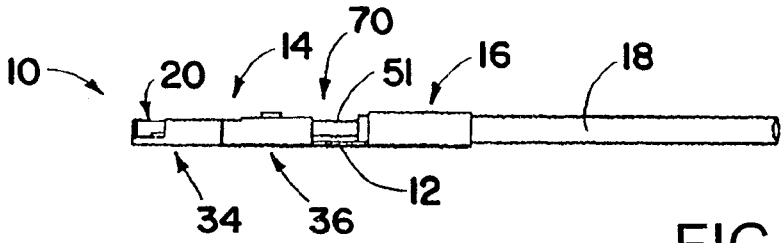
FIG. 6 is another side view of the electrical cable connector of FIG. 1A.

As illustrated in FIG. 1B, a number of the cable connector modules 10 of FIG. 1A may be retained in relatively accurately spaced-apart relation by the connector carrier 11 of the connection system 1. The connector carrier 11 may include an alignment feature 21, such as slots, grooves, walls, and/or detents, to align and/or to hold the cable connector modules 10 therein.

In an exemplary use, each of cable connectors 10 may connect a cable, having ground and signal conductors, to a circuit board, e.g., the back plane of a circuit board, where the connections, terminals, and/or conductors are arranged at relatively close spacing, an example being from about 2 mm to about 2.25 mm pitch or centers. With plural cable connectors 10 held at specified locations by the connector carrier 11, the relative spacing or positioning of the cable connectors is accurately maintained. The cable connector 10 may be used to connect relatively high frequency signals, such as those encountered in modern computer equipment, telecommunications equipment and/or other electrical or electronic equipment.

The voltage reference plane 12 provides primary structural support for the cable connector 10. The voltage reference plane 12 may be made of metal, which usually has greater strength and stiffness characteristics per equivalent size unit, e.g., unit volume, area, thickness, etc., than plastic or similar dielectric or electrically non-conductive materials typically used in electrical cable connectors. Therefore, less material is needed for primary structural support, and for maintenance of physical shape and mechanical and electrical integrity of the cable connector 10, than would be required if the cable connector were made primarily of plastic, for example; and, accordingly, features of invention allow the cable connector 10 to be relatively strong and of good electrical and mechanical quality and integrity and impedance maintenance and/or control while also being relatively thin in size allowing relatively high density arrangement of terminals thereof, such as, for example, the 2 mm to 2.25 mm pitch mentioned above. Since the cable connectors 10 are relatively thin, there is space between them in the connector carrier 11 for the alignment feature 21 to include an interior wall 22 of dielectric material to separate and/or to help align the respective cable connectors and, if needed, to help guide the other terminals mentioned above (e.g., pins) properly into engagement with the terminals 20.

Figure 7:
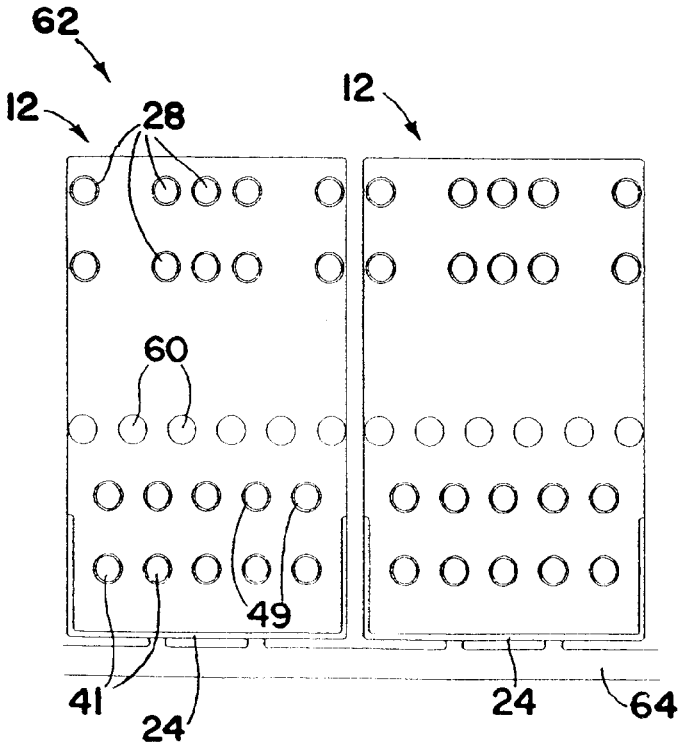
FIGS. 7 and 8 are orthogonal views of a voltage reference plane of the electrical cable connector of FIG. 1A.
Figure 8:
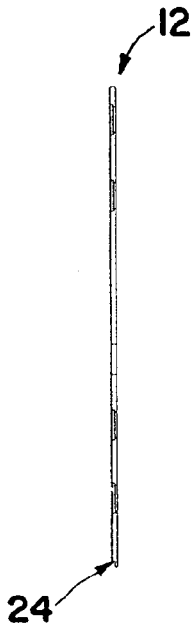
Figure 9:
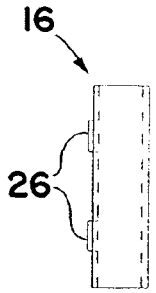
FIG. 9 is an end view of a cable retainer of the electrical cable connector of FIG. 1A.
Figure 10:
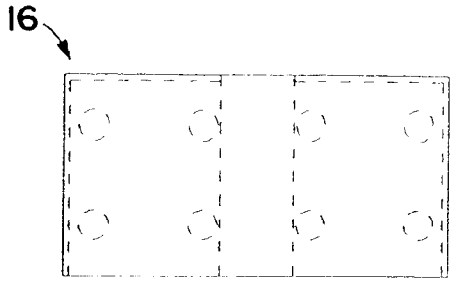
FIG. 10 is a plan view of the cable retainer of FIG. 9.
Figure 11:
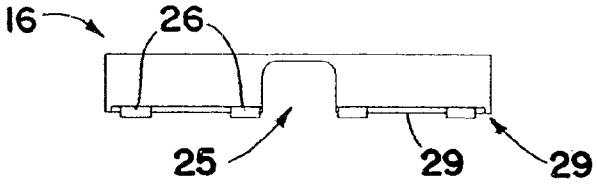
FIG. 11 is a side view of the cable retainer of FIG. 9.

The voltage reference plane 12, which also is shown in detail in FIGS. 7 and 8, may be substantially the length and width of the cable connector 10. As shown in FIG. 1, the voltage reference plane 12 may have a wider portion 23 in the vicinity of and attached to the cable retainer or strain relief 16. The wider portion 23 may be used in conjunction with an interior ledge of a carrier, described below, to facilitate proper insertion of the electrical cable connector 10 into the carrier.

The voltage reference plane 12 is made of an electrically conducting material such as an electrically-conductive metal. It may be, for example, 0.010 inches thick, and may be made out of nickel-silver which is flash gold plated, or out of other suitable materials.

The voltage reference plane 12 has a thin edge 24 etched around a portion of its perimeter, as best seen in FIGS. 7 and 8.

The cable retainer 16 (also shown in FIGS. 9–11) has a recess 25 therein for receiving the cable 18. The cable retainer 16 may be made of a non-conducting material such as plastic. In an exemplary embodiment, the cable retainer 16 is made of a glass-filled liquid crystal polymer. The cable retainer 16 has protrusions 26 for connection of the retainer to the voltage reference plane 12. The protrusions 26 fit into holes 28 in the voltage reference plane 12 (FIG. 4), with the cable 18 in the recess 24, between the cable retainer 16 and the voltage reference plane 12. The protrusions 26 may be heat staked while in the holes 28, thereby securing the cable retainer 16 to the voltage reference plane 12 with the cable 18 therebetween.

The cable retainer 16 may have a protruding lip 29 (FIG. 11) which fits around a portion of the perimeter of the voltage reference plane 12, thereby providing the cable connector 10 with a plastic outer edge at that portion of its perimeter. The plastic outer edge may be less likely than the metal edge of the voltage reference plane 12 to damage other components which interface with the cable connector 10.

It will be appreciated that more than one cable 18 may be secured to the voltage reference plane 12 via a suitable cable retainer with multiple recesses and perhaps a different configuration of protrusions, there being a sufficient number of the holes 28 in the voltage reference plane 12 for accommodating a different configuration of cable retainer protrusions.

It will be appreciated that alternatively the cable retainer 16 may be directly overmolded (or insert molded) on the voltage reference plane 12 to secure the cable 18 to the voltage reference plane.

Figure 12:
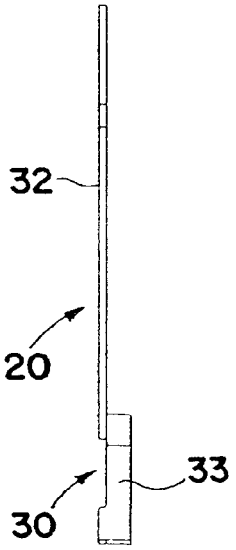
FIGS. 12 and 13 are orthogonal views of terminals of the electrical cable connector of FIG. 1A.
Figure 13:
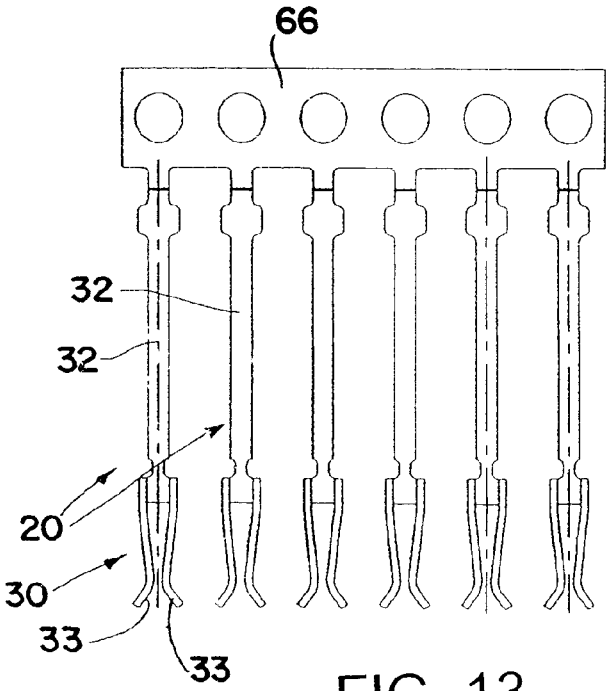

The terminals 20 include respective pin portions 30 and planar portions 32 (FIGS. 12 and 13). The pin portions 30 are cooperatively positioned and operative as a female contact able to receive and electrically to connect to suitable pins (not shown). The planar portions 32 are electrically connected to respective pin portions 30 for providing electrical pathways across the connection portion 14 of the cable connector 10. Each pin portion 30 includes a pair of pin clamping members 33 which may be resiliently pushed apart by a pin entering the terminal 20 and, thus, resiliently held to such a pin. The pin portion 30 and the planar portion 32 of each terminal 20 may be integrally formed as a single unit, as is shown, or they may be separate parts which are coupled together, such as by welding. The terminals 20 are made of an electrically conducting material, such as metal. In an exemplary embodiment the terminals are made out of beryllium copper alloy 190, with the pin clamping members 33 being gold plated for improved conductivity.

Figure 16:
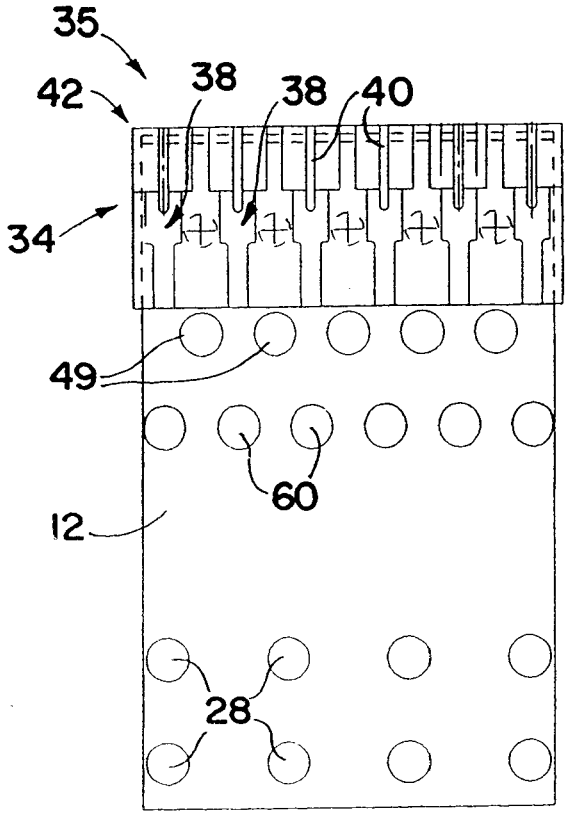
FIG. 16 is a plan view of the voltage reference plane subassembly of FIG. 14.
Figure 17:
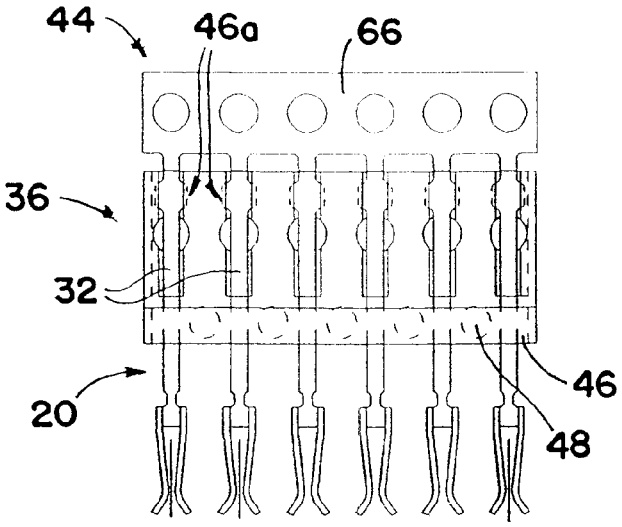
FIG. 17 is an plan view of a header subassembly of the electrical cable connector of FIG. 1A.
Figure 18:
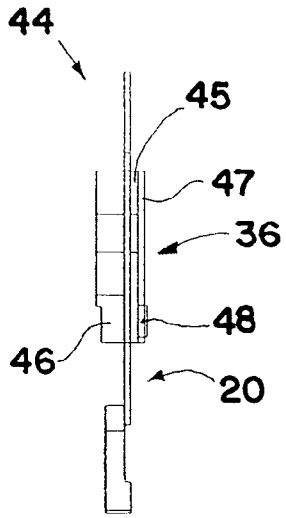
FIG. 18 is a side view of the header subassembly of FIG. 17.
Figure 19:
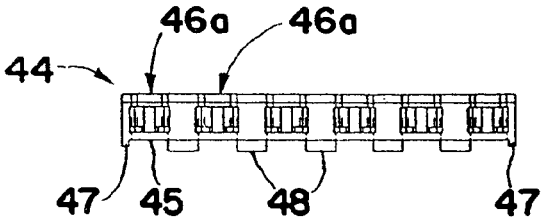
FIG. 19 is a end view of the header subassembly of FIG. 17.

The connection portion 14 of the cable connector 10 includes a pair of electrically non-conducting members—a contact receiver 34, which with the voltage reference plane 12 forms a plane subassembly 35 (also shown in FIGS. 14–16), and a header 36 (also shown in FIGS. 17–19). Both the contact receiver 34 and the header 36 may be made of plastic, such as the glass-filled liquid crystal polymer mentioned above.

Figure 14:
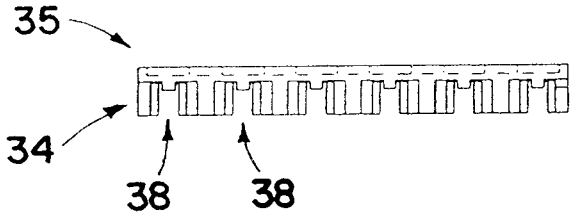
FIG. 14 is an end view of a voltage reference plane subassembly of the electrical cable connector of FIG. 1A.
Figure 15:
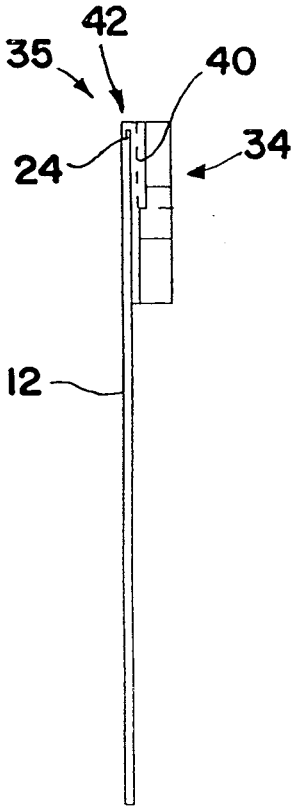
FIG. 15 is a side view of the voltage reference plane subassembly of FIG. 14.

The contact receiver 34 includes a plurality of terminal channels 38 for receiving the planar portions 32 of the terminals 20 best shown in FIGS. 14–16. A raised ridge 40 in each of the terminal channels 38 separates the pin clamping members 33 of each of the pin portions 30, thereby preventing the pin clamping members 33 from coming together and possibly unduly preventing entry of pins therebetween.

The contact receiver 34 may be overmolded or insert molded onto the voltage reference plane 12 to form the plane subassembly 35, as shown in FIGS. 14–16. The mold may be shaped such that portions of the contact receiver 34 protrude through connection holes 41 in the voltage reference plane 12, with such protrusions later used to heat stake the contact receiver 34 to the voltage reference plane 12. In addition, an overhang portion 42 of the contact receiver 34 overhangs the thin edge 22 of the voltage reference plane 12, thereby providing the cable connector 10 with a plastic outer edge in that region, and also thereby better securing the contact receiver 34 to the voltage reference plane 12 to form the plane subassembly 35.

The header 36 is overmolded (or insert molded) onto the terminals 20 to form a header subassembly 44, as shown in FIGS. 17–19. The header 36 includes a planar layer 45 which serves to insulate the planar portions 32 of the terminals 20 from the voltage reference plane 12, the planar layer 45 being underneath the planar portions 32 in the illustrated embodiment.

The header 36 also includes a bar 46 atop and between the planar portions 32. The bar 46, in conjunction with the planar layer 45, secures the terminals 20 within the header 36. Other portions of the planar portions 32 are accessible through wire channels **46*a*. Header overlap portions 47 overlap sides of the voltage reference plane 12 when the header subassembly 44 is attached to the voltage reference plane 12**.

The header subassembly 44 includes header protrusions 48 which are inserted into holes 49 in the voltage reference plane 12. Some or all of the header protrusions 48 may be used to heat stake the header subassembly 44 to the voltage reference plane 12. It will be appreciated that some of the protrusions may be used for reasons other than heat staking the header subassembly 44 to the voltage reference plane 12, such as for connecting several of the cable connectors 10 together in a modular fashion, protrusions for modular connection fitting into corresponding recesses which may be provided in the bar 46. Heat staking all of the header protrusions 48 will, however, reduce the overall thickness of the cable connector 10.

The cable 18 includes one or more signal wires 50 and one or more reference voltage (or ground) wires 51 (one of which is shown in FIG. 1, for example) that are connected to respective of the terminals 20. The reference voltage wire 51 is also connected to the voltage reference plane 12, such as by a weldment connection 52. The wires 50 and 51 are connected to the respective terminals 20 at connections 56 between the wires and respective of the planar portions 32 of the terminals 20. The connections 56 may be made for example by spot welding, with openings 60 through the voltage reference plane 12 and the planar layer 45 providing access to the planar portions 32 to effect such spot welding.

The cable connector 10 may be formed by reel-to-reel processing according to the following method, which involves independent reel-to-reel formation of plane subassemblies 35 and header subassemblies 44.

In forming the plane subassemblies 35, a reel 62 of voltage reference planes 12 is cut or stamped from a suitable roll of material, with the voltage reference planes 12 connected by an attached carrier 64 as shown in FIG. 7. The holes 28, 41 and 49, and the openings 60 may be formed in the voltage reference planes 12 during the same step as the formation of the voltage reference planes 12, or in a separate step.

Contact receivers 34 are then formed on the voltage reference planes 12 by overmolding plastic onto the voltage reference planes 12.

In forming the header subassemblies 44, groups of terminals 20 are cut or stamped from a suitable roll of material, with a terminal carrier 66 linking the terminals 20, as shown in FIGS. 13 and 17. The pin clamping portions 33 of the terminals 20 are formed by bending, and the portions 33 are gold plated.

The headers 36 are then formed on the terminals 20 by overmolding, with header protrusions 48 also formed in the same overmolding step. The header subassembly 44 may be secured during the overmolding operation by pins in the openings 60 which serve both to maintain the cable connector 10 in the proper position and to keep plastic material from entering the openings 60.

The reel of plane subassemblies 35 and the reel of header subassemblies 44 are then joined together. The header subassemblies 44 are placed in respective of the voltage reference plane subassemblies 35, with the planar portions 32 in the terminal channels 38 and the header protrusions 48 in the corresponding holes 49 in the voltage reference planes 12. The header protrusions 48 are then heat staked and the terminal carriers 66 are removed. The combined assembly may then be re-reeled.

A cable 18 is then placed on each voltage reference plane 12, and the cable retainer 16 is placed to secure the cable 18 to the voltage reference plane 12, the protrusions 26 of the cable retainer 16 fitting into the corresponding holes 28 in the voltage reference plane 12. The cable retainer 16 may then be heat staked to the voltage reference plane 12. It will be appreciated that the attachment of the cable retainer 16 may be included as part of the attachment of the header subassembly 44 to the plane subassembly 35.

The reference voltage wire 51 is then connected to the voltage reference plane 12 such as by welding to form the weldment connection 52. Thereafter, insulation on the wires 50 and 51 is suitably removed, the wires are placed in respective of the wire channels 46*a* in contact with respective of the planar portions 32 of the terminals 20, and the wires 50 and 51 are connected to the respective terminals 20 such as by spot welding.

It will be appreciated that all of the above steps may be undertaken without removing the voltage reference planes 12 from the carrier 64.

It will be appreciated that other methods of manufacture may be employed to form the above-described cable connector or similar cable connectors.

The height of the cable retainer 16 may be only slightly greater than the height of the cable 18, with only a thin layer of plastic material (for example a layer of material about 0.010 inch thick) covering the cable 18.

The overall thickness of the cable connector 10 may be less than 2 mm, with the thickness of an exemplary embodiment being 1.95 mm. However, it will be appreciated that the cable connector may have a greater or lesser thickness than the exemplary embodiment.

It will be appreciated that the cable 18 and wires 50 and 51 are not individually within any of the overmolded plastic parts, passing only through the cable retainer 16, which is heat staked to the voltage reference plane 12 rather than being overmolded on the voltage reference plane 12. The cable 18 and the wires 50 and 51 not being within an overmolded part avoids the possible changes in impedance which may occur when hot plastic under pressure surrounds a wire and presses against it. The individual wires 50 and 51 are separated from each other within an air gap 70 between the connection portion 14 and the cable retainer 16. The wires 50 and 51 are then placed in the open wire channels 46a for connection to the respective terminals 20.

It will further be appreciated that the terminals 20 are also open to air along much of their length, having an exposed face throughout the wire channels 46a and through the terminal channels 38, and being surrounded by plastic, only when they pass through the bar 46. It will be appreciated that this configuration leads to improvement in the uniformity of impedance throughout the cable connector 10.

It will be appreciated that the above-described cable connector is merely one example of a high density cable connector with an electrically-conductive structural member, and that numerous variations are possible.

Figure 20:
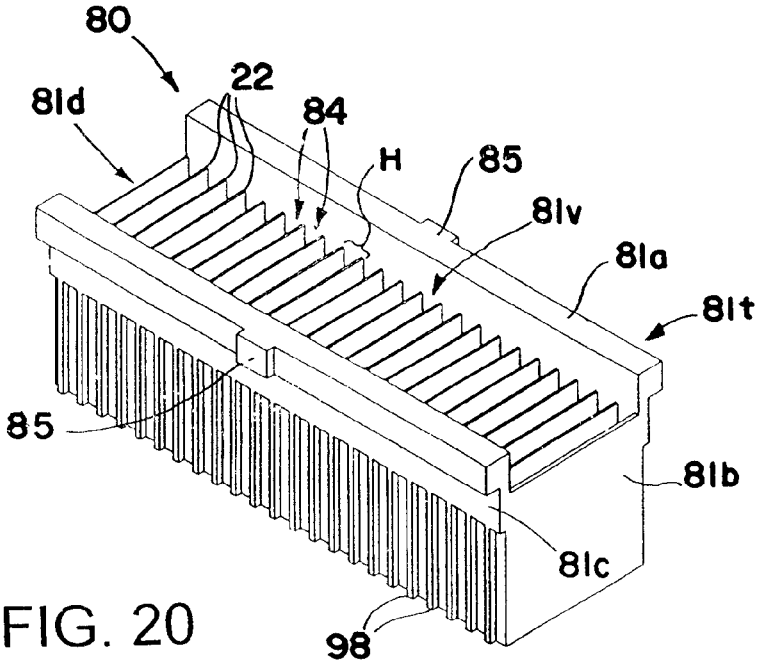
FIG. 20 is a perspective view of a connector carrier according to the present invention.
Figure 22:
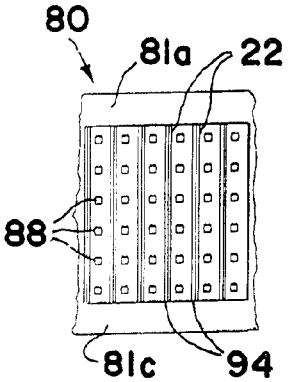
FIG. 22 is a fragmentary plan view of the carrier of FIG. 20.
Figure 21:
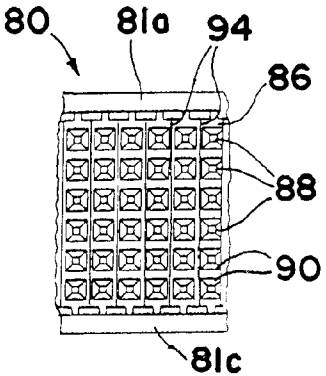
FIG. 21 is a fragmentary bottom view of the carrier of FIG. 20.

Referring to FIGS. 20–22, the connector carrier 11 is shown for receiving cable connectors such as the cable connector 10 shown in FIGS. 1–19 and described above. The connector carrier 11 has exterior walls 81*a*–81*d* which enclose an interior volume 81*v* which is open at its top 81*t*. Within the interior volume 81*v* are interior walls 22 which define slots 84 therebetween for receiving cable connectors such as the cable connector 10. It will be understood in addition that some of the slots 84, i.e., those one the ends of the connector 11, are bounded by an interior wall and an exterior wall substantially parallel to that interior wall. The spacing between the interior walls 22 is on the order of about 2 mm. The interior walls 22 may be substantially parallel to one another, and the slots 84 may have substantially the same dimensions as one another.

The carrier 11 may be made out of molded plastic, and the interior walls 22 are thin, in order to provide greater thickness of the slots 84 to allow for greater thickness of cable connectors such as the cable connector 10 to be inserted therein, while still maintaining the 2 mm spacing. For example, the interior walls 22 may be about 0.008 inches thick. Thus the height H of each of the slots 84 may be approximately 1.98 mm or less.

The cable connector modules 10 may have a thickness that is sufficiently less than the height H of the slots 84 to provide some amount of extra space in which the cable connector may move or float. For example the cable connector modules 10 may have a thickness of several thousandths of an inch less than the height H, and/or may have a thickness of 1.92 mm or less. This difference between the height H of the slots 84 and the thicknessbv of the individual cable connector modules 10 may allow the cable connector modules to "float" within their respective slots. This "float"

facilitates alignment of individual cable connector modules 10 with their respective mating pins or other connectors, the alignment of the individual cable connector modules 10 not impacting the alignment of other cable connector modules in other of the slots 84. Since each of the cable connector modules 10 of the invention, in a sense, self-aligns with mating terminals, forces which are encountered during the mating of prior connectors that cause a slight distortion of not-so-well-aligned terminals, are reduced or avoided.

The connector carrier 11 has an alignment feature or referencing structure, such as referencing protrusions 85, thereupon. The referencing protrusions 85 allow the connector carrier 11 to be accurately located relative to a carrier piece (not shown) which houses pins or other devices configured to be received by electrical cable connectors housed in the slots 84.

The carrier 11 has a bottom wall 86 which has holes or apertures 88 therein. The corresponding holes 88 for adjacent slots 84 of an exemplary embodiment may be spaced 2 mm apart, with the spacing of adjacent holes of the same slot being spaced 2.25 mm apart, although it will be appreciated that other spacings are possible. The holes 88 allow the carrier 11 to be placed atop a corresponding array of pins, the pins protruding through the holes 88 for connection to cable connectors 10 inserted in the slots 84.

Referring to FIG. 21 the bottom wall 86 of the carrier 11 has beveled portions 90 around each of the holes 88. The beveled portions 90 facilitate guiding of the carrier 11 over the corresponding array of pins and guiding the pins into engagement with respective terminals 20. It will be appreciated that the beveled portions 90 may be omitted, if desired.

The bottom wall 86 has slits 94 therein between adjacent of the rows of the holes 88. The slits 94 may extend partially up the external walls 81*a* and 81*c*. The slits 94 allow ground or reference voltage plates, which may be a part of or may be enclosed by the carrier piece which the carrier 11 mates with, to enter the interior volume 81*v*. The cable connectors 10 may be arrayed within the connector carrier 11 such that the voltage reference planes 12 of the cable connectors are in contact with the ground or reference voltage plates protruding into the interior volume 81*v* through the slits 94.

The bottom wall 86 prevents access to a bottom end of the interior volume 81v, except through the holes 88 and the slits 94. In contrast, open access is available to an opposite top end of the interior volume 81v. It will be appreciated, however, that alternative configurations may be employed.

The exterior walls 81*a* and 81*c* have exterior protrusions or ridges 98 thereupon for fitting into corresponding grooves which may be in a corresponding mating connector or carrier piece (not shown).

The carrier 11 enables precise placement, relative to the reference protrusions 85, of the cable connectors 10 in the slots 84. Since the cable connector module 10 inserted into a specific slot is maintained in that slot by the interior walls 22 which are adjacent to that slot, the error in placement of each individual cable connector module corresponds to the error in the placement of the interior walls adjacent to that slot. The interior walls 22 may be precisely placed relative to the reference protrusions 85, allowing accurate locating of the cable connector modules 10 inserted into the slots 84. The use of slots 84 bounded by interior walls 22 thus enables avoidance of the problem of addition of individual tolerance errors, which as noted above may occur in connectors utilizing stacked connector modules.

What follows now are several additional embodiments of the invention. The details of certain common similar features of the additional embodiments and the embodiment or embodiments described above are omitted in the description of the additional embodiments for the sake of brevity. It will be appreciated that features of the various additional embodiments may be combined with one another and may be combined with features of the embodiment or embodiments described above.

Figure 23:
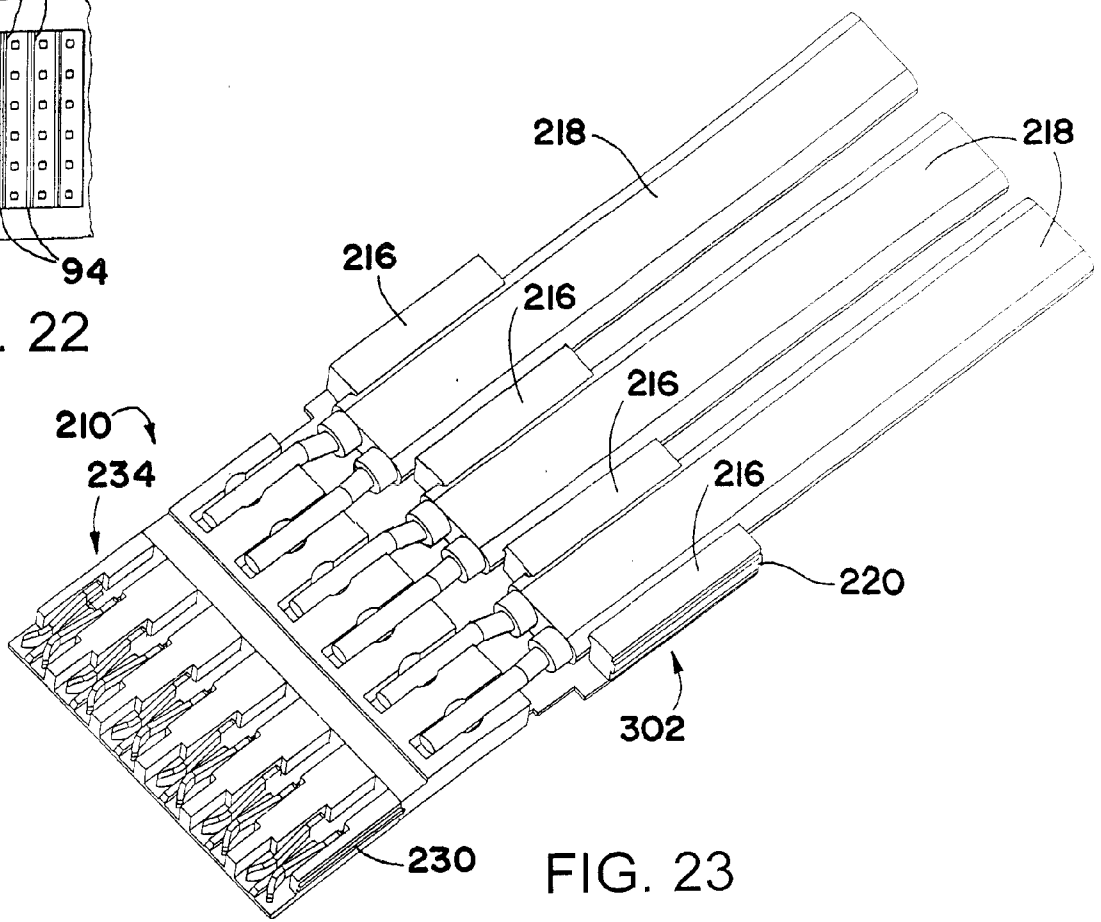
FIG. 23 is a perspective view of an alternate embodiment high density electrical cable connector according to the present invention.

Turning to FIG. 23, an embodiment of electrical cable connector or cable connector module 210 is shown. The cable connector 210 includes multiple strain relief members 216 attached to a spine 212, for securing multiple cables 218 between adjacent pairs of the strain relief members. The outermost of the strain relief members 216 have protrusions or ridges thereupon, such as the protrusion 220. The protrusions on the outermost strain relief members fit into corresponding grooves on a conductor carrier, as described below with respect to FIG. 24.

The cable connector 210 also includes protrusions 230 on either side of a contact receiver 234. The protrusions 230 also fit in corresponding grooves on the conductor carrier. The protrusions 230 may be have the same or a different width and/or height than the protrusions 220.

Figure 24:
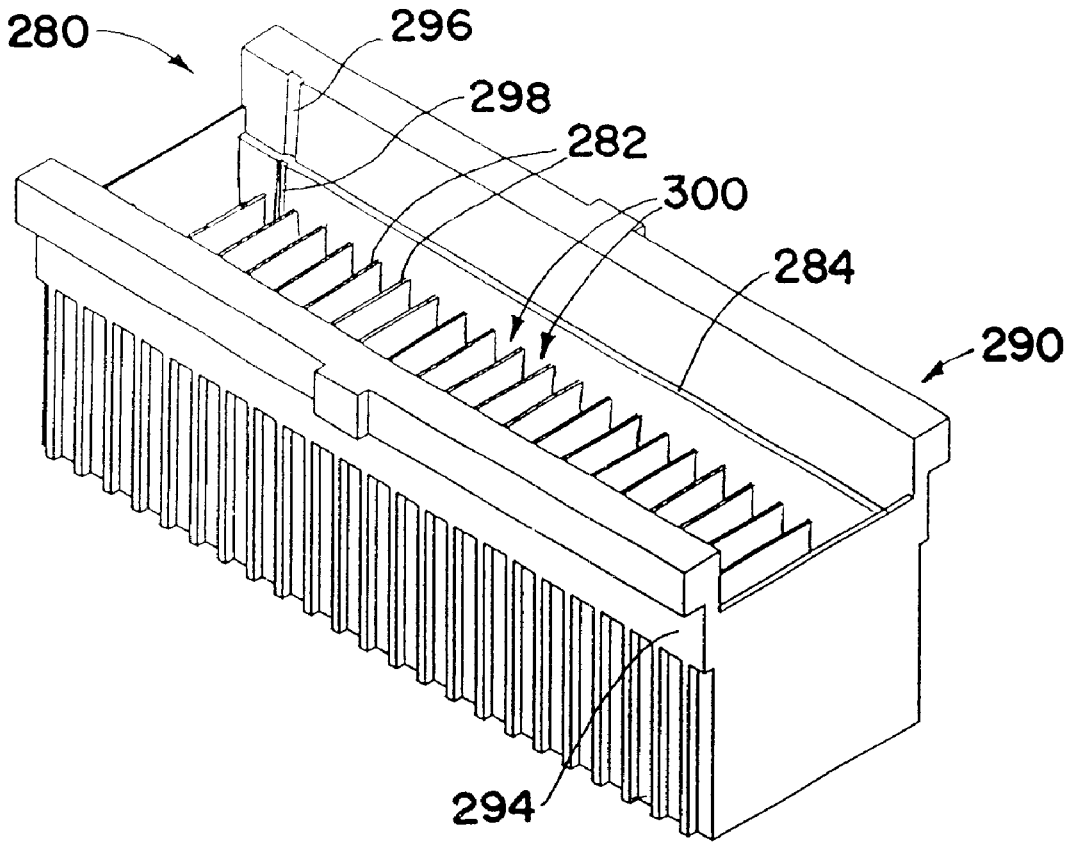
FIG. 24 is a perspective view of an alternate embodiment connector carrier according to the present invention.

Referring now to FIG. 24, another embodiment of connector carrier 280 is shown. The carrier 280 has interior walls 282 that do not extend to a top open end of the carrier. A ledge 284 is along an inner surface 286 of an exterior wall 290 of the carrier 280. A corresponding ledge may be on the opposite exterior wall 294. The ledge 284 may be such that the narrower portion of the spine 212 may pass the ledge, but the wider portion of the spine is too wide to pass.

The inner surface 286 has an upper groove 296 above the ledge 284, and a lower groove 298 below the ledge 284. The grooves 296 and 298 correspond to the protrusions 220 and 230, respectively, of the cable connector module 210 shown in FIG. 23. Thus it will be appreciated that the grooves 296 and 298 may have different widths and/or thicknesses from one another. The grooves 296 and 298 may be aligned with one another or may be offset from one another. Although only one of each type of groove is shown in FIG. 24, it will be appreciated that one groove of each type may be provided for each of the slots of the carrier 280, to facilitate loading of the cable connectors 210 into the connector carrier. The grooves 296 and 298 and the corresponding protrusions 220 and 230 may aid in proper alignment of the modules 210 relative to slots 300 of the carrier 280. The ledge 284 may limit insertion of the modules 210 into the slots 300, since the ledge may be configured such that a wide end 302 of the modules (FIG. 23) is too wide to pass past the ledge.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical cable connector assembly comprising:

a connector carrier which includes exterior walls enclosing an interior volume, and a plurality of interior walls within the interior volume, the interior walls dividing at least a portion of the interior volume into a plurality of rectangular slots; and electrical cable connector modules inserted into the slots, each of the cable connector modules including a metal structural member; a plurality of electrically conductive terminals; and an electrically non-conductive member attached to both the structural member and the terminals; and wherein the structural member provides primary structural support for the terminals;

wherein each of the cable connector modules further includes a strain relief attached to the structural member, wherein the structural member also provides primary structural support for the strain relief; and wherein the non-conductive member and the strain relief are at respective opposite ends of the structural member, with an air gap between the non-conductive member and the strain relief.

2. The assembly of claim 1, wherein space in the slots permits movement of the respective cable connector modules therein to facilitate self-alignment during use.

3. The assembly of claim 1, wherein the interior walls are substantially parallel to one another.

4. The assembly of claim 3, wherein the bottom end has a plurality of parallel slits therein, the slits being substantially parallel to the interior walls.

5. The assembly of claim 1, wherein the carrier has a top end which allows open access to the portion of the interior volume, and a bottom end opposite the top end, the bottom end having a plurality of apertures therein to allow access therethrough to the interior volume.

6. An electrical cable connector assembly comprising:

a plurality of electrical cable connector modules, each of the cable connector modules including a metal structural member, a plurality of electrically conductive terminals connected to a cable; and an electrically non-conductive member attached to both the structural member and the terminals; and wherein the structural member provides primary structural support for the terminals; and a connector carrier having means for receiving and positioning individual of the modules;

wherein each of the cable connector modules further includes a strain relief attached to the structural member, wherein the structural member also provides primary structural support for the strain relief; and wherein the nonconductive member and the strain relief are at respective opposite ends of the structural member, with an air gap between the non-conductive member and the strain relief.

7. The assembly of claim 6, wherein space in the slots permits movement of the respective cable connector modules therein to facilitate self-alignment during use.

8. An electrical cable connector module, comprising:

an electrically conductive metal plate, a plurality of electrically conductive terminals secured to the plate by an electrically non-conductive retainer; and an electrical cable secured to the plate by a retainer, the cable having a plurality of conductors electrically coupled to respective terminals;

wherein the module includes a section in which the metal plate provides substantially all of the structural integrity of the module.

9. The module of claim 8, wherein the thickness of the module is about 2.25 mm or less.

10. The module of claim 9, wherein the thickness of the module is less than about 2 mm.

11. The module of claim 8, wherein the pitch spacing between adjacent terminals of the cable connector module is about 2.25 mm or less.

12. The module of claim 11, wherein the pitch spacing between adjacent terminals of the cable connector module is about 2 mm.

13. A cable connector system comprising a carrier having an interior with slots for receiving plural cable connector modules of claim 8, the carrier having one end through which further terminals may be inserted to electrical connection relation with respective connector module terminals.

14. The system of claim 13, wherein space in the slots permits movement of the respective cable connector modules therein to facilitate self-alignment during use.

15. The system of claim 13, the carrier having electrically non-conductive walls between respective adjacent cable connector modules.

16. The system of claim 13, the carrier having alignment features for aligning the system with another device for connection therewith.

17. The assembly of claim 1, wherein the metal structural member has a thickness of at least 0.010 inches.

18. The assembly of claim 1, wherein the metal structural member has a thickness of about 0.010 inches.

19. The assembly of claim 6, wherein the metal structural member has a thickness of at least 0.010 inches.

20. The assembly of claim 6, wherein the metal structural member has a thickness of about 0.010 inches.

21. The module of claim 8, wherein the metal plate has a thickness of at least 0.010 inches.

22. The module of claim 8, wherein the metal plate has a thickness of about 0.010 inches.

23. An electrical cable connector assembly comprising:

a connector carrier which includes exterior walls enclosing an interior volume, and a plurality of interior walls within the interior volume, the interior walls dividing at least a portion of the interior volume into a plurality of rectangular slots; and electrical cable connector modules inserted into the slots, each of the cable connector modules including a metal structural member; a plurality of electrically conductive terminals, and an electrically non-conductive member attached to both the structural member and the terminals; and wherein the metal structural member provides primary structural support for the terminals;

wherein the modules each include a section in which the metal structural member provides substantially all of the structural integrity of the module.

24. The assembly of claim 23, wherein the section of the modules is a center section.

25. The assembly of claim 24, wherein the center section includes an air gap between the non-conductive members and a strain relief.

26. The assembly of claim 24, wherein the metal structural member has a thickness of at least 0.010 inches.

27. The assembly of claim 24, wherein the metal structural member has a thickness of about 0.010 inches.

28. An electrical cable connector assembly comprising;

a connector carrier which includes exterior walls enclosing an interior volume, and a plurality of interior walls within the interior volume, the interior walls dividing at least a portion of the interior volume into a plurality of rectangular slots; and electrical cable connector modules inserted into the slots, each of the cable connector modules including a metal structural member, a plurality of electrically conductive terminals; and an electrically non-conductive member attached to both the structural member and the terminals;

wherein the metal structural member provides primary structural support for the terminals; and wherein, for each of the modules, the metal structural member extends fully along a length of the module, and the nonconductive member does not extend along the length of the module.

29. The assembly of claim 28, wherein each of the modules includes an air gap in at least a portion of the length of the module where the non-conductive member does not extend.

30. The assembly of claim 29, wherein for each of the modules the air gap is in a center section of the module.

31. The assembly of claim 30, wherein for each of the modules the metal structural member provides substantially all of the structural integrity of the module in the center section of the module.

32. The assembly of claim 31, wherein each of the modules includes a strain relief coupled to the metal structural member, and wherein for each of the modules the strain relief and the non-conductive member are on opposite sides of the air gap.

33. The assembly of claim 32, wherein for each of the modules the metal structural member has a thickness of at least 0.010 inches.

34. The assembly of claim 32, wherein for each of the modules the metal structural member has a thickness of about 0.010 inches.

35. The assembly of claim 1, wherein the slots are of a size to receive an electrical cable connector and wherein space in the slots permits movement of the respective electrical cable connectors therein to facilitate self-alignment during use.

36. The assembly of claim 23, wherein the slots are of a size to receive an electrical cable connector and wherein space in the slots permits movement of the respective electrical cable connectors therein to facilitate self-alignment during use.

37. The assembly of claim 28, wherein the slots are of a size to receive an electrical cable connector and wherein space in the slots permits movement of the respective electrical cable connectors therein to facilitate self-alignment during use.

* * * * *